US008840241B2

(12) United States Patent
Fletcher et al.

(10) Patent No.: US 8,840,241 B2
(45) Date of Patent: Sep. 23, 2014

(54) SYSTEM AND METHOD FOR ADJUSTING AN ELECTROSTATIC FIELD IN AN INKJET PRINTER

(75) Inventors: Gerald Fletcher, Pittsford, NY (US); Joannes N. M. de Jong, Hopewell Junction, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 13/589,356

(22) Filed: Aug. 20, 2012

(65) Prior Publication Data

US 2014/0049586 A1 Feb. 20, 2014

(51) Int. Cl.
*B41J 2/01* (2006.01)

(52) U.S. Cl.
USPC ..... 347/104

(58) Field of Classification Search
CPC ..... B41J 2/0085; B41J 11/007
See application file for complete search history.

(56) References Cited

U.S. PATENT DOCUMENTS

| | | | | |
|---|---|---|---|---|
| 3,760,229 | A | 9/1973 | Silverberg | |
| 3,961,193 | A | 6/1976 | Hudson | |
| 5,326,598 | A * | 7/1994 | Seaver et al. | 427/473 |
| 6,079,814 | A | 6/2000 | Lean et al. | |
| 6,166,550 | A | 12/2000 | Abramsohn et al. | |
| 6,320,387 | B1 | 11/2001 | Abramsohn et al. | |
| 6,508,540 | B1 * | 1/2003 | Lean et al. | 347/55 |
| 6,510,296 | B2 | 1/2003 | Less et al. | |
| 7,216,968 | B2 | 5/2007 | Smith et al. | |
| 7,789,505 | B2 | 9/2010 | Ageishi | |
| 7,918,552 | B2 | 4/2011 | Ageishi | |
| 8,025,391 | B2 | 9/2011 | Nakayama | |
| 8,142,010 | B2 | 3/2012 | Ageishi | |
| 2012/0045265 | A1 | 2/2012 | Zaretsky | |

FOREIGN PATENT DOCUMENTS

JP 2006298596 A * 11/2006

* cited by examiner

*Primary Examiner* — Shelby Fidler
*Assistant Examiner* — Tracey McMillion
(74) *Attorney, Agent, or Firm* — Maginot, Moore & Beck, LLP

(57) ABSTRACT

A system and method for adjusting an electrostatic field in a print zone of an inkjet printer. The printer includes an electrostatic tacking device to hold a sheet of recording media to a transport belt moving through the print zone for imaging with one or more inkjet printheads. A sensor determines the electrostatic field before the print zone and adjusts the electrostatic field with a corotron disposed after the tacking device and before the print zone. Reduction of the electrostatic field in the print zone can reduce imaging errors resulting from electrostatic fields.

8 Claims, 4 Drawing Sheets

SYSTEM AND METHOD FOR ADJUSTING AN ELECTROSTATIC FIELD IN AN INKJET PRINTER

TECHNICAL FIELD

This disclosure relates generally to an inkjet printer and more particularly to an inkjet printer having an electrostatic transport belt and an adjustable electrostatic field to reduce field induced printing artifacts in a print zone.

BACKGROUND

In general, inkjet printing machines or printers include at least one printhead unit that ejects drops of liquid ink onto an imaging receiving member. The printhead units include one or more printheads that operate a plurality of inkjets that eject liquid ink onto the image receiving member. The ink can be stored in reservoirs located within cartridges installed in the printer.

Different types of ink can be used in inkjet printers such as an aqueous ink or an ink emulsion. In one type of inkjet printer, ink is supplied in a gel form. The gel is heated to a predetermined temperature to change the viscosity of the ink so the ink is suitable for ejection by a printhead. Other inkjet printers receive ink in a solid form, i.e. phase change ink, and then melt the solid ink to generate liquid ink for ejection onto the image receiving member. Phase change inks remain in a solid phase at ambient temperature, but transition to a liquid phase at an elevated temperature. Once the ejected ink is deposited on an image receiving member, the ink droplets solidify. The solid ink is typically placed in an ink loader and delivered through a feed chute or channel to a melting device that melts the ink. The melted ink is then collected in a reservoir and supplied to one or more printheads through a conduit or the like.

An inkjet printer can include one or more printheads. Each printhead contains an array of individual nozzles for ejecting drops of ink across an open gap to the image receiving member to form an image. The area adjacent the printhead or printheads where ink can be deposited is generally known as a print zone. The image receiving member can be a continuous web of recording media, one or more media sheets, or a rotating surface, such as a print drum or endless belt. Images printed on a rotating surface are later transferred to recording media, either continuous or sheet, by a mechanical force in a transfix nip formed by the rotating surface and a transfix roller.

In an inkjet printhead, individual piezoelectric, thermal, or acoustic actuators generate mechanical forces that expel ink through an orifice from an ink filled conduit in response to an electrical voltage signal, sometimes called a firing signal. The firing signal is generated by a printhead controller in accordance with image data. An inkjet printer forms a printed image in accordance with the image data by printing a pattern of individual ink drops at particular locations on the image receiving member. The locations where the ink drops land are sometimes called "ink drop locations," "ink drop positions," or "pixels." Thus, a printing operation can be viewed as the placement of ink drops on an image receiving member in accordance with image data.

Various printing systems can include a moving belt that carries one or more sheets of print media through a predetermined path while images are formed on the media sheets. An example of such a device is an inkjet printer that includes a moving belt. The moving belt carries one or more media sheets past one or more marking stations. Each marking station can include at least one printhead that ejects ink drops onto the media sheets as the sheets move through the print zone. The marking stations can be located at different positions along the path of the belt. In some embodiments, each marking station is configured to eject ink having a single color. Each marking station forms a portion of a color image using one ink color on each media sheet, and the arrangement of the different colored drops of ink from the marking stations forms a full-color image on the media sheets. One common example of such a printing system forms images using a combination of inks having cyan, magenta, yellow, and black (CMYK) colors.

When using a moving belt, inkjet printers can use a sheet holddown device to insure the sheets remain stable and fixed to the belt during printing. Some printers incorporate a vacuum source that is operatively connected to a vacuum platen to hold the sheets in place. The vacuum platen includes a plurality of passageways or ports to enable air to be drawn through the platen towards the vacuum source. The vacuum platen is located adjacent to the back side of the belt as the belt moves the print media by the marking stations. The belt may include a plurality of apertures or holes to enable the vacuum source to exert a negative pressure on the media sheets through the belt. Thus, the air being pulled through the platen pulls the media against the belt to help maintain the position of the media while being printed. Other embodiments can include an electrostatic member positioned adjacent to the belt that generates an electrical charge to counteract an electrical charge on the media sheets, thereby attracting the media sheets to the moving belt. Still other embodiments can include mechanical members, such as gripper bars or holddown rollers that push the media sheets against the moving belt, and consequently push the moving belt against a support member, such as a backer roller, positioned on the back side of the moving belt to hold the media sheets in place.

SUMMARY

An inkjet printer includes an electrostatic tacking device to tack the media to a moving belt held flat to a conductive platen in an imaging zone. An electrostatic field reducer is configured to adjust the electrostatic field of the media to reduce electrostatic field image artifacts. The printer is configured to deposit ink on a sheet of recording media moving through a print zone with a transport belt configured to transport the sheet of recording media past the printhead in a process direction. An electrostatic tacking device is disposed adjacent to the transport belt and is configured to electrostatically tack the sheet of recording media to the transport belt. A corotron is disposed adjacent to the transport belt between the electrostatic tacking device and the printhead, wherein the corotron is configured to apply an electrostatic field to the transport belt to neutralize or substantially neutralize the sum of the net charge per area on the media and the net charge per area on the belt. A sensor, disposed adjacent to the transport belt between the corotron and the printhead, is configured to sense an electrostatic field and to generate an electrostatic field signal representative of the sensed field. A controller is operatively connected to the sensor and to the corotron and is configured to adjust the DC voltage applied to the corotron in response to the electrostatic field signal generated by the sensor.

A method of adjusting an electrostatic field in a print zone of a printer having an electrostatically charged media transport includes using an electrostatic field reducer. The method of forming an ink image on a sheet of recording media being moved in a process direction by a transport belt through a print zone of an inkjet printer includes affixing the sheet of recording media to the transport belt at a location prior to the print zone with an electrostatic charge configured to provide a charged sheet of recording media. The method also includes modifying the electrostatic charge of the charged sheet of recording media prior to the print zone after the first location and moving the modified charged sheet of recording media through the print zone.

In another embodiment, a method of adjusting an electrostatic field in a print zone of an inkjet printer to reduce the effects of the electrostatic field during the deposition of ink on recording media moving though the print zone in a process direction includes applying a charge to the recording media prior to the recording media moving through the print zone to affix the recording media to the transport belt. The method includes measuring the electrostatic field at a location prior to the print zone along the process direction and modifying the electrostatic field in the print zone by adjusting the applied electrostatic field of the recording media.

DETAILED DESCRIPTION

Figure 1:
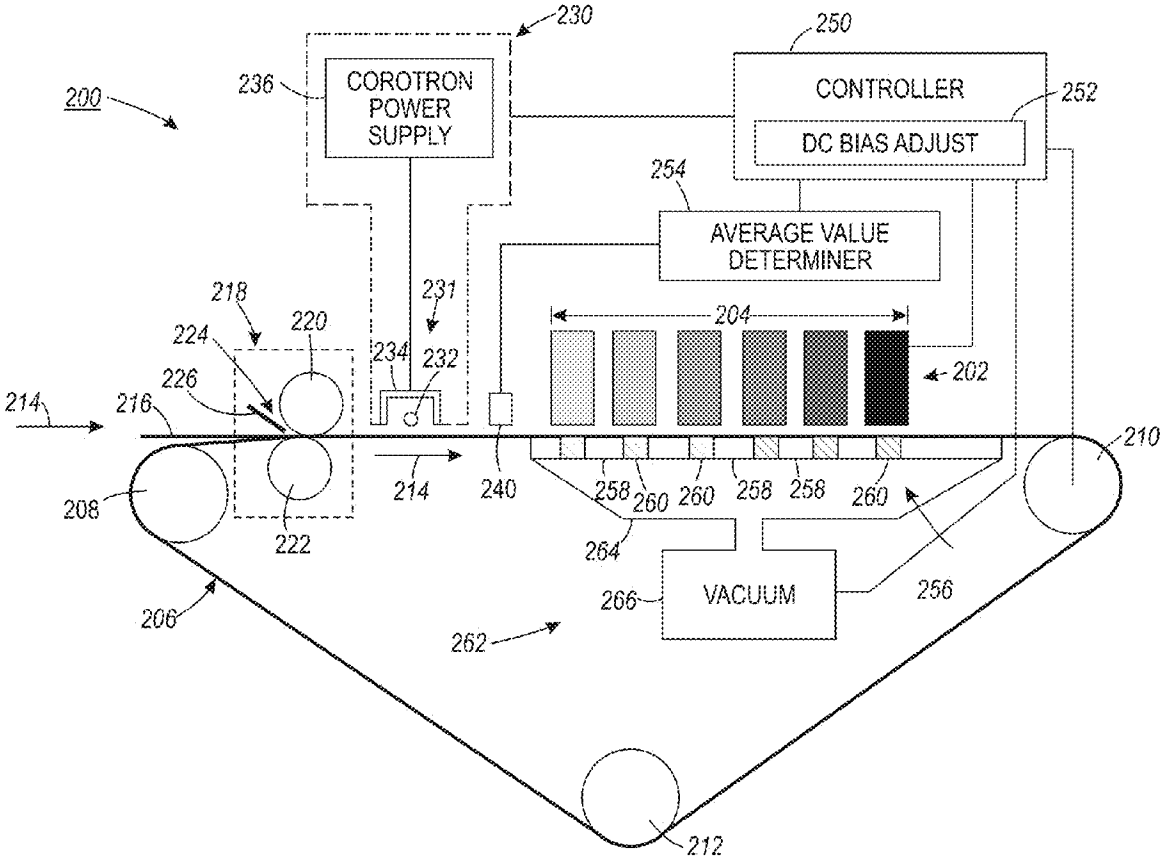
FIG. 1 is a schematic diagram of an inkjet printer including an electrostatic tacking device to tack sheets of recording media to a transport belt moving through a print zone and an electrostatic adjusting device to adjust the electrostatic field in the print zone.

For a general understanding of the environment for the system and method disclosed herein as well as the details for the system and method, the drawings are referenced throughout this document. In the drawings, like reference numerals designate like elements. As used herein, the word "printer" encompasses any apparatus that performs a print outputting function for any purpose, such as a digital copier, bookmaking machine, facsimile machine, a multi-function machine, or the like. As used herein, the term media sheet refers to a piece of recordable print media that may receive images in a printer such as an inkjet printer. As used herein, the term "print zone" refers to a section of a printing device where media sheets move past one or more printheads. The printheads eject ink onto the media sheets to form images, and may form color images using inks having various different colors. The print zone can also include a member that holds media sheets flat to enable uniform printing. As used herein, the terms belt, conveyor belt, and sheet carrying device all refer to a movable member that is configured to carry one or more media sheets past printheads arranged in a print zone. The belt moves through the print zone in a direction referred to as a "process direction" and the term "cross-process direction" is a direction that is perpendicular to the process direction. The belt enters the print zone from an "upstream" position and moves "downstream" in the process direction through the print zone.

Figure 4:
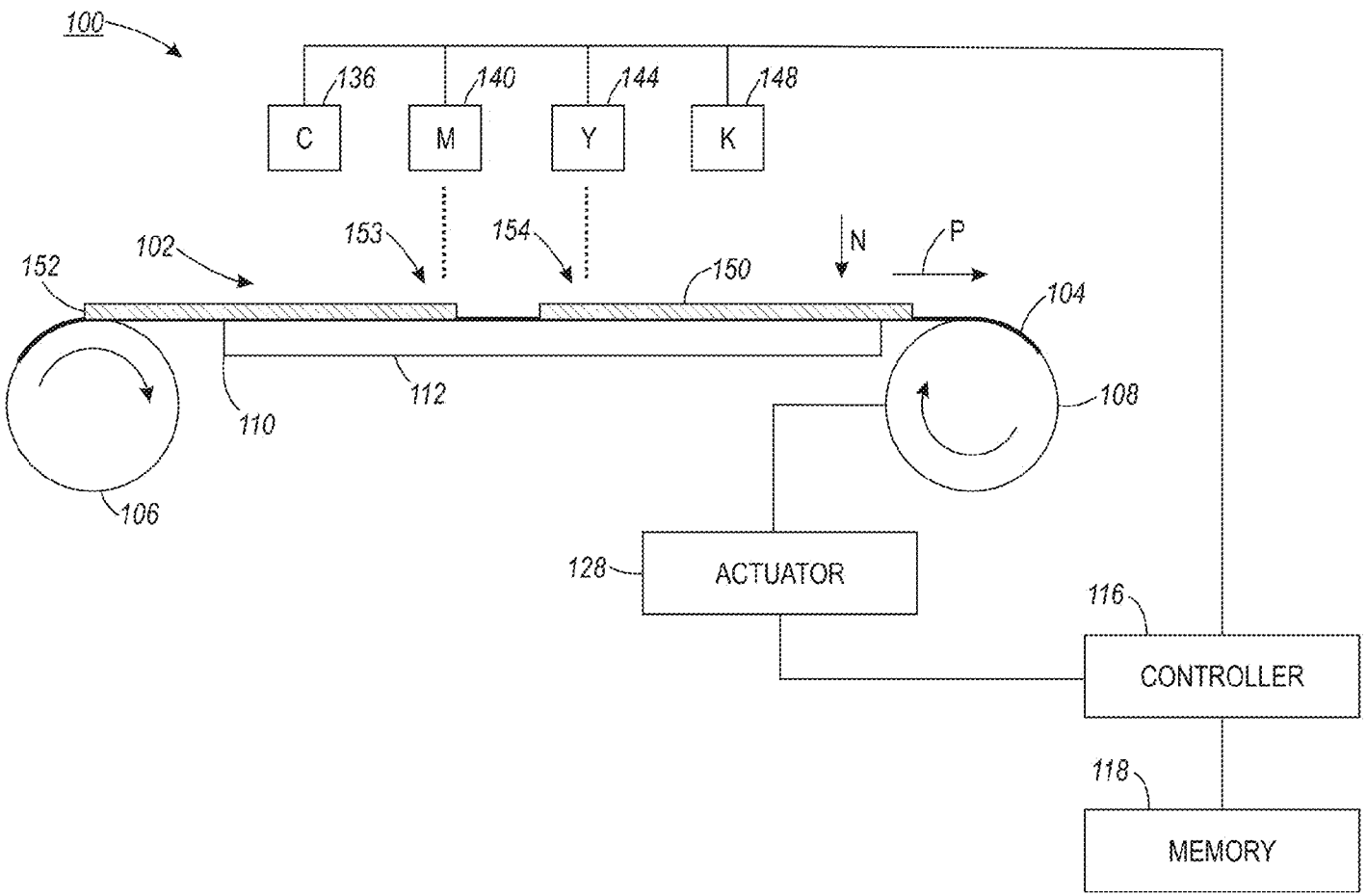
FIG. 4 is a schematic diagram of a marking unit including a moving belt configured to carry one or more media sheets past printheads in a print zone in the marking unit.

FIG. 4 illustrates an inkjet printer 100 having elements pertinent to the present disclosure. In the embodiment shown, the printer 100 implements an inkjet print process for printing onto sheets of recording media. Although the system and method for adjusting electrostatic fields in a print zone are described below with reference to the printers depicted in FIG. 1 and FIG. 4, the subject method and apparatus disclosed herein can be used in any printer, continuous web inkjet printer or cartridge inkjet printers, having printheads which eject ink directly onto a web image substrate or sheets of recording media.

FIG. 4 depicts a schematic view of an inkjet printer 100 including a moving belt 104 that is configured to carry media sheets past printheads 136, 140, 144, and 148 for imaging operations. The printer 100 further includes a steering roller 106, a drive roller 108, a support plate or platen 112, a controller 116, and an actuator 128. A print zone 102 in the printer 100 includes the portion of the marking unit containing the printheads 136, 140, 144, and 148, the support plate 112, and the portion of the belt 104 that moves over the support plate 112. A portion of belt 104 extends between the steering roller 106 and the drive roller 108 over support plate 112. In the embodiment of FIG. 4, belt 104 is an endless belt that moves from the drive roller 108 through a belt tensioning assembly (omitted for clarity) and returns to the steering roller 106. Drive roller 108 is operatively connected to the actuator 128 that rotates the drive roller 108. Actuator 128 may be a direct current (DC) or alternating current (AC) electric motor, stepper motor, hydrostatic drive, or any other suitable actuator. The actuator may be directly operatively connected to the drive roller 108, or in some embodiments, the actuator is operatively connected to the drive roller 108 using one or more gears, belts, or other transmission systems.

The drive roller 108 pulls the belt 104 in the process direction P as the drive roller 108 rotates. A rotational velocity sensor (not shown) can generate an electrical signal corresponding to the rotational velocity of the drive roller 108. Common embodiments of the rotational velocity sensor 120 include mechanical encoders, optical wheel encoders, and Hall effect sensors. A sheet sensor (not shown) can be positioned at a first end 110 of the support plate 112 at the upstream end of the print zone 102 to identify the position of media sheets as the media sheets enter the print zone 102. In some embodiments, the sheet sensor is an optical detector that generates a signal in response to detection of a leading edge of the media sheet as the media sheet begins to move into the print zone 102 and a trailing edge of the media sheet when the entire media sheet has entered the print zone 102.

The support plate 112 is configured to have a low friction surface. The low friction surface can be achieved by coating the support plate 112 with a suitable coating material. A typical coating material used in such applications is polytetrafluoroethylene. Alternatively, the low friction surface of the support plate can be achieved by choosing a support plate material that ensures a smooth surface.

The vacuum platen 112 is operatively connected to a negative pressure source (not shown) that applies negative pressure to the surface of the belt 104 as the belt 104 moves over the vacuum platen 112. In a system that uses vacuum to hold the media to the belt, the belt 104 includes openings such as holes that enable the negative pressure applied through the vacuum platen 112 to engage one or more media sheets, such as media sheets 150 and 152, which are carried on the media belt 104. The negative pressure holds the media sheets 150 and 152 in place against the belt 104 to prevent the sheets from curling and to maintain a uniform distance between each sheet and printheads 136, 140, 144, and 148. The negative pressure applied to the media sheets 150 and 152 increases the normal force N between the belt 104 and the vacuum platen 112 in regions of the belt 104 that carry the media sheets when compared to regions of the belt 104 that are empty of recording sheets. In FIG. 4, media sheet 152 is partially over the vacuum platen 112 with a portion of the media sheet 152 being positioned beyond a first end 110 of the vacuum platen 112 and within the print zone 102. The first end 110 of the vacuum platen 112 also forms a first end of the print zone 102, with the belt 104 carrying media sheets past the first end 110 into the print zone 102 in the process direction P. A corresponding increase in the dynamic frictional forces, or drag forces, between the belt 104 and the vacuum platen 112 applied to the belt 104 also occurs when one or more media sheets are positioned over the vacuum platen 112. While marking unit 100 includes a vacuum platen 112 configured to hold media sheets 150 and 152 in place, alternative configurations may include an electrostatic member, gripper bars, or other structures that hold the media sheets against the belt 104. In a system that uses electrostatic forces to hold the media to the belt, the belt 104 can optionally include but will generally not be required to have openings and in systems without openings the drag on the belt 104 due to the vacuum below the belt will not increase as the media move along the process direction.

Printheads 136, 140, 144, and 148 in print zone 102 are configured to eject drops of ink having cyan, magenta, yellow, and black colors, respectively, onto media sheets, such as media sheets 150 and 152, as the media sheets pass each printhead. The printheads eject ink drops of various types of ink including, but not limited to, solvent based, UV-curable, aqueous, gel, and phase-change inks. While the print zone 102 depicts four printheads configured to eject inks having four different colors, alternative printhead configurations include different arrangements and numbers of printheads that eject inks having different colors than those described herein.

Controller 116 is operatively connected to the actuator 128 and printheads 136, 140, 144, and 148. During an imaging operation, the controller 116 operates the actuator 128 to move one or more media sheets through the print zone 102, and the controller 116 operates the printheads 136, 140, 144, and 148 to eject ink drops onto the media sheets to form images. During imaging operations, the drive roller 108 rotates as directed by the controller 116 at a substantially constant angular velocity to pull the belt 104 and media sheets through the print zone at a substantially constant velocity in the process direction P. The controller identifies the rotational speed of the drive roller 108 from the electrical signals generated by the velocity sensor.

The instructions and data required to perform the programmed functions may be stored in a memory 118 operatively connected to the controller 116 and associated processors. The processors, their memories, and interface circuitry configure the controller 116 to perform the processes, described more fully below. The controller 116 reads, captures, prepares and manages the image data flow between image input sources and the printheads 136, 140, 144, and 148. As such, the controller 116 is a main multi-tasking processor for operating and controlling all of the other printer subsystems and functions, including printing processes.

The controller 116 can be implemented with general or specialized programmable processors that execute programmed instructions. The instructions and data required to perform the programmed functions can be stored in memory associated with the processors or controllers. The processors, associated memories, and interface circuitry configure the controllers to perform the processes that enable the printer to move the recording sheets past the printheads at a predetermined speed and to deposit the ink on recording sheets in response to image data. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. While the printer 100 describes one embodiment of an ink jet printer, the system and method of adjusting electrostatic fields as described below with respect to the printer of FIG. 1 can be incorporated into the printer of FIG. 4.

Referring now to FIG. 1, a printing system 200 provides a system and method for controlling the electrostatic fields located within a print zone 204 defined by the location of a plurality of printheads 202 disposed adjacent to a transport belt 206. The print zone 204 generally extends from a first printhead to a last printhead of the plurality of printheads 202 and is defined as the area beneath the printheads and adjacent to the belt 206. Each one of the plurality of printheads 202 can be configured to print a different color of ink. In the illustrated embodiment for instance, the printheads can deposit ink of the colors cyan, magenta, yellow, black, red and green.

As illustrated in FIG. 1, the printing system 200 includes the continuous transport belt 206 supported for movement by a steering roller 208, a driver roller 210 and a tensioning roller 212. The transport belt 206 can include a continuous belt driven in a process direction 214 by the drive roller 210 which is operatively connected to a motor (not shown) configured to move the transport belt 206 in the process direction 214. The belt 206 is maintained in a state of tension by the tensioning roller 212, the position of which can be adjusted to increase or decrease the tension of the belt 206. The steering roller 208 includes a steering mechanism (not shown) which can adjust a lateral location, or cross-process location, of the transport belt 206 during movement in the process direction across the steering roller 208.

The transport belt 206 can include a belt transport material having known or identifiable electrical properties. The transport belt can include an insulating, a semi-conductive, or a layered configuration of materials.

As the transport belt 206 moves in the process direction, one or more sheets of recording media 216, one of which is illustrated, are carried by the transport belt 206 into the print zone 204 for printing with ink ejected by one or more of the plurality of printheads 202. To insure that the sheet of recording media remains at a substantially fixed location on the belt 206, the sheet 216 is placed on the transport belt 206 before the sheet enters an electrostatic tacking device 218. The electrostatic tacking device 218 is located along the process direction after the steering roller 216 but before the print zone 204. The electrostatic tacking device 218 can include a tacking roller 220 disposed on one side of the belt 206, illustrated here as a top side, and can include a counter roller 222, disposed on another side of the belt 206, here illustrated as a bottom side of the belt 206. Optionally the tacking roller 220 can be replaced by many other charging devices such as a corotron device (pin, wire or dielectric coated wire corona generation chargers), biased charging blades or brushes and other such charging devices known in the art that are capable of applying a controlled amount charge to the media.

The tacking roller 220 and the counter roller 222 are each disposed adjacent to and in contact with the transport belt 206. In one embodiment the tacking roller 220 rotates freely and the counter roller 222 is driven by a motor (not shown). Other configurations are possible and can include the tacking roller 220 being driven by motor and the counter roller 222 rotating freely. Both of the rollers 220 and 222 can be motor driven. In addition, one of or both of the rollers can rotate freely, where rotation is caused by the belt motion. One or both of the rollers 220 and 222 can also be positively biased toward the transport belt 206 to form a nip 224 between the tacking roller 220 and the transport belt 206. The rollers 220 and 222 can each be configured to apply an electrostatic charge of an opposite polarity such that the sheet of recording media moving through the nip 224 adheres to the belt due to the applied electrostatic charge.

One or both of the tacking roller 220 and counter roller 222 are operatively connected to one or more power supplies (not shown) which supply a current to the appropriate roller to generate an electrostatic tacking field between the rollers 220 and 222. As the sheet of recording media 216 moves into the nip 224, the sheet 224 is tacked to or held in place on the transport belt 206 which has been electrostatically charged by at least one of the tacking roller 220 and the counter roller 222. A contact blade 226 can be located at an upstream position before the nip 224 to direct the sheet of recording media 216 onto the surface of the transport belt 206. The application of a force by the contact blade 226 can provide a downward force to place the sheet of recording media 216 flush against the surface of the transport belt 206.

Once the sheet of recording media 216 moves through the nip 224, the sheet 216 is electrostatically charged to one polarity and the belt 206 is electrostatically charged to the opposite polarity. The electrostatic charges on the sheet and belt hold the sheet 216 substantially in place at the location determined by the introduction of the sheet to the nip 224. While electrostatic tacking can provide a satisfactory mechanism for adhering the recording media to the belt, the charges placed on the media and belt can create an electrostatic field between the recording media and the printheads 202 and this can influence the ejection of ink as the sheets of recording media 216 enter, move through, and exit the print zone 204. In some cases, the intensity of the electrostatic field in the print zone 204 can be such that ink ejection is disrupted sufficiently to adversely affect image quality.

In the embodiment shown in FIG. 1, the platen 256 contains slots 260 that are positioned below each of the active areas of the printheads 202. The purpose of the slots is to create a region below the active area of each printhead where there is substantially empty space below the charged belt and media, while providing some mechanical support for the belt beyond the active jetting areas of the printheads to maintain belt flatness in the imaging zones. If the size of the slot is chosen to be sufficiently large, the electrostatic field between the media and the printheads in the active jetting areas of the printheads can be substantially equal to the algebraic sum of the net charge density on the media and belt, divided by a constant referred to as the permittivity of free space ($\in_0$). A sufficiently large slot can generally be taken to mean that the edges of the slots are at least 5 millimeters (mm) and more preferably >10 millimeters beyond the active jetting regions of the printheads. Therefore, with sufficiently wide slots, in order to minimize the fields between the media and the active jetting areas of the printheads, the net charge density (charge/area) on the media can be arranged to be equal and opposite in polarity to the net charge density on the belt 206 when the media and belt are moving past the printhead regions.

The media and belt charging station 218 can place a charge density of one polarity on the media and charge density of the opposite polarity on the belt so that the sum of these charge densities will tend toward zero as desired. However, there will generally be a small offset in the magnitudes of the net charge densities on the media and on the belt so that the sum of the charge densities will typically not be zero after the charging station 218. A term of interest in electrostatics is the quantity charge density ($\sigma$) divided by a constant referred to as the permittivity of free space ($\in_0$) since this term is related to the component of the electric field produced by the charge density. As described herein, this term will be referred to with the symbol "E" and this term will be used to describe the magnitude of the charge density. A convenient unit for this term is "volts/micron", which is also the unit for an electrostatic field. If $E_M$ is the quantity E that is related to the amount of net charge density on the media and $E_B$ is the E related to the net charge density on the belt, then the electrostatic field present between the media and the jetting regions of the printheads can be substantially $E_M+E_B$ for the sufficiently wide slot configuration of the platen described above. Ideally this sum can be zero to avoid undesirable electrostatic interaction with the imaging process for some stressful imaging processes and ink materials conditions, although some small lever or amount of electrostatic field can be allowed and possibly even desired for many imaging processes and ink materials. Typically, fields between the media and printhead that are <0.5 volts/micron can be acceptable for some systems and fields <0.2 volts/micron can be acceptable even for fairly stressful systems which can include, for example, high conductivity or high dielectric constant ink materials, and low viscosity inks.

In one embodiment, a positive charge can be placed on the media and negative charge can be placed on the belt, or the order can be reversed. For the present description, the described embodiment includes a positive polarity charge placed onto the media and negative polarity charge placed on the belt in the charging step 218. A typical value for $E_M$ to get maximum tacking force between the media and the belt is around 35 Volts/micron, and this level for $E_M$ will be used for discussion here. It can be shown by air breakdown considerations that the negative counter charge on the belt right after the charging zone 218 will necessarily be near this level in magnitude but can be anywhere between around negative 32 to around negative 38 Volts/micron. That is, there can be as much as a plus or minus 3 volts/micron offset in the net initial charge density of the media plus belt ($E_M+E_B$) as the media moves past the charging zone. The amount of the offset will depend on various details of the charging configuration. Therefore, without further countermeasures there can be a field as high as around 3 Volts/micron in magnitude between the media and the jetting regions of the printheads with the wide slotted platen configuration described above. Therefore, to insure that fields can be in a typically desired range of <0.5 volts/micron and preferably <0.2 Volts/micron, additional countermeasures to reduce the field are typically needed.

To reduce the electrostatic field in the print zone during imaging, the printer includes an electrostatic field adjustment device 230 configured to adjust the electrostatic field caused by the offset of the net charge density on the recording media and the net charge density on the transport belt 206. The electrostatic field adjustment device 230 includes a charging device including, for instance, a corotron 231 having a coronode 232 and a corotron shield 234 disposed adjacent to the coronode 232. A corotron power supply 236 is operatively connected to the corotron 231 and generates an alternating current and a direct current, each of which is applied to the coronode 232 for energization thereof. A corona generated by the coronode 232 in direct response to the alternating and direct current supplied by the power supply 236 adjusts the level or amount of the electrostatic field generated by the sheets of recording media after being charged by the electrostatic tacking device 218. The adjustment device can adjust the magnitude of the charge density on the media to be substantially equal in magnitude to the opposite polarity charge density on the belt so that the electrostatic field between the media and printheads can be maintained at a low level in the slotted platen case of FIG. 1.

An optional configuration can include the corona device located below the belt rather than above the belt, and then the generated corona charge can adjust the level of the net charge on the transport belt to be substantially equal in magnitude to the net charge density on the media. In an alternate charging device arrangement, the charging device can be located below the belt rather than above the belt in certain types of printer architectures. Such a configuration can be useful where space constraints are a consideration, can substantially eliminate jam concerns at the field reducer zone, can reduce contamination issues for the corona device. For ease of discussion, the corotron arrangement shown in FIG. 1 is discussed herein.

If the corona device is located above the belt, the charge on the belt is not modified, only the charge on the media is modified. In like fashion, the charge on the media is not modified if the corona device is located below the belt, only the charge on the belt is modified. In either configuration, the effect on the net electrostatic tacking force between the media and the belt is not greatly altered. The electrostatic pressure is proportional to the net charge density on the media times the net charge density on the belt. Assuming the corona device is above the belt, the change in the net charge on the media is limited to around <3/30 and most typically is <1/30 of the net charge on the media, so the change in electrostatic pressure is most typically <3.3%. Similarly, the change in the belt charge density and electrostatic pressure is most typically <3.3% if the corona device is located below the belt.

Referring to the FIG. 1 configuration for electrostatic field adjustment device 230, in order to allow a large latitude for corotron power supply setpoints for creating substantially zero or very low net electrostatic charge density $E_M+E_B$ for the media plus belt (and hence low field between the media and printheads, also known as imagers), any grounded conductive members below the belt can be sufficiently far from the belt in the active region of the corona charging beam. Typically, a distance of >5 mm and more preferably >10 mm can be "sufficiently far". Because the corona beam width is typically only slightly larger than the physical width of the device, any grounded conductive parts should be at least 5 mm and preferably >10 mm away from the edges of the corona device, and preferably >10 mm below the bottom of the belt.

In one embodiment, the coronode 232 of the corotron 231 can be displaced approximately 9-12 millimeters from the top surface of the recording media, although this distance can be varied. The shield of the corona device 234 can typically include parts that are conductive, such as metal. In order to maintain a controlled corona charging condition for one embodiment, the distance between the conductive portions of the shield and the belt can determine the operating power supply latitude for achieving substantially zero net charge density for the media plus belt. Consequently, the conductive portions of the shield should not be too close to the belt and can be at least 3 mm from the belt surface for typical corona device configurations and can be >5 mm from the surface. In an optional configuration where the corona device is placed below the belt rather than above, then conductive members above the belt should be far from the belt in the corona beam region. For example, to achieve very wide operating latitude for the device, conductive members should be >10 mm above the belt in the corona region.

While the electrostatic field adjustment device 230 generates a controllable electrostatic field which could increase the electrostatic field in the print zone 204, the device 230 is generally configured to operate as an electrostatic field reducer by driving the net charge of the media plus belt substantially to zero. As mentioned above, one consideration is to place grounded conductive parts sufficiently far from the belt in the active regions of the corona beam since such placement allows wide operating conditions for the corona device.

There can be a tendency for an AC corona device to drive a surface moving below the device to a certain level of potential. This tendency can be measured by placing a stationary metal plate below the device at, for example, the transport belt position in FIG. 1, applying varying levels of DC potential to the plate, and measuring the amount of DC current density that flows to the plate versus the DC voltage on the plate. The current density is the DC current divided by the length of the coronode perpendicular to the belt travel direction in FIG. 1. The plot of current density that results is typically referred to as the "bare plate characteristic" of the corona device. For many types of AC corona devices and a wide range of operating conditions, the curve can be typically a straight line, but this is not a necessary condition. For simplicity of discussion, it will be assumed that the curve is a simple straight line with a slope of the DC plate current density versus DC plate voltage having the value $m_{BP}$. The DC current to the bare plate can approach zero at a certain bare plate voltage level and can be called "the intercept voltage level", and is referred to as $V_I$. The plate voltage $V_I$ that drives the bare plate characteristic curve to a zero DC plate current is the level of voltage that the corona device will tend to drive any surface moving past the corona device in a real system. For example, for the moving media and belt in FIG. 1 traveling at a velocity $v_B$ past the corona device, the AC corona device can attempt to drive the voltage above the media plus belt to the level $V_I$ as it emerges past the active region of the corona device. If $C_T$ is the effective capacitance/area between the moving surfaces being charged and any surrounding nearby grounded conductive surfaces, then the voltage above the media plus belt immediately after the corona device can be substantially driven to $V_I$ if the quantity $\alpha_{BP}=m_{BP}/(C_T v)$ is much greater than 1. Consequently, corona device conditions for 230 can be chosen so that $\alpha_{BP}>>1$.

For the present application therefore $m_{BP}$ can be selected to be sufficiently large and $C_T$ can be selected to be preferably small. If the distance between the belt and nearby metal parts in the active corona region near 232 is greater than around 1 mm, the capacitance term $C_T$ is dominated by the distance to the nearby conductive parts, and the capacitance term can be very small. The slope $m_{BP}$ depends on various details of the geometry of the corona device. For a given device geometry, the slope increases with increasing AC coronode current level and with decreasing distance between the coronode and the surface that is being charged. For a given belt speed v, and a given determined level of $C_T$, the desired AC corona current latitude range to achieve $\alpha_{BP}>>1$ can be determined by measurements of the bare plate characteristic curves. If the distance from the belt to nearby metal parts in the active region of the coronode is larger than 1 mm, the term $C_T$ is typically so very small that there can be an extremely wide tolerance allowed for the choice of corona device geometries and AC settings to achieve the desired condition $\alpha_{BP}>>1$. The potential above the media plus belt will substantially be driven toward $V_I$ immediately past the charging station 230 for this application by proper choice of the corotron AC current setting.

The intercept voltage $V_I$ of the media plus belt can be slightly dependent on the device geometry and environmental factors. For a given device, environment and AC current level, the intercept voltage is mainly determined by the level of DC voltage offset applied to the coronode. At a zero DC coronode condition, $V_I$ will typically be in the <plus or minus 400 volt range for many corona devices and conditions. A change of DC coronode voltage by say +1000 volts can generally shift $V_I$ by around the same +1000 volts. Thus at a given set of conditions, the DC coronode voltage can be used to control the level of voltage that the media plus belt will achieve after passing through the AC charging device 230. The resulting level of field between the media and the printheads related to the level of $V_I$ depends primarily on the capacitance parameter $C_T$ discussed above, and this in turn is dominated by the physical distance between the belt and any conductive parts near the active region of the corona device. If $d_B$ is the effective distance between the belt and nearby metal parts, then the field that occurs between the media and the active region of the printheads for the wide platen slot configuration described herein can be substantially around the quality $V_I/d_B$. As an example, if a grounded conductive plate is placed 1 mm below the belt in the corona device region shown in FIG. 1, then $d_B$ will be 1 mm (=1000 microns) and the field at the printheads for a corona device setting that result in a $V_I$ levels of 500 volts will be around 0.5 Volts/micron. If the grounded conductive plate is moved further away to say a 5 mm spacing, the same corona device settings will now result in a field at the printheads of around 0.1 Volts/micron. At the 1 mm plate spacing, if the $V_I$ level varies by say 500 volts due to setpoint changes or for example environmental factors, this can result in a field variation of 0.5 Volts/micron at the printheads, while at a plate spacing of 5 mm this will only result in a field variation of 0.1 Volts/micron. In order to allow very wide corona device operating tolerances for achieving low fields at the printheads, metal parts can be placed sufficiently far from the belt in the active region of the corona device 230.

On the other hand, some level of slightly increased sensitivity of the field to the level of $V_I$ may be desired for the control system disclosed below that senses the field past the corona device 230 and adjusts the DC voltage level on the device to drive the field to the desired low level. Increased sensitivity of $V_I$ to the DC voltage level on the corona device can be achieved for example by strategically placing a grounded plate at a controlled distance away from the belt. Since too much sensitivity can be problematic for control stability, effective distances $b_B$ to conductive members can generally be smaller than around 3 mm.

A sensor 240, such as electrostatic field probe, is located along the transport path 214 between the corotron 231 and the print zone 204. If the slots in the platen 256 are sufficiently large, say >10 mm beyond the active jetting regions of any of the printheads, then the region of the belt below the sensor should be located much further from conductive members when compared to the distance between the probe and the belt. The sensor will only be insensitive to the spacing between the sensor and the media if conductive members below the belt in sensor region are much further than the distance between the probe and the belt, for instance >10 times further away. Such a distance can provide spacing insensitivity for tolerant and stable control. The sensor 240 measures the net charge density of the belt plus media moving past the device by recording the voltage drop $V_M$ across a standard capacitor that is electrically connected between the probe and electrical ground (which is the induced charge on the conductive probe face) and using a field probe of known area. The induced charge density (charge per area) on the probe face can then be determined due to the location of the field below the probe face. By Gauss's Law, the field below the conductive probe is directly proportional to the measured charge density on the probe face, which is thus proportional to the measured voltage signal on the probe, $V_M$. The proportionality constant can be determined by placing the probe in a known field, such as placing a biased plate at a potential V a distance h away from the probe to create a known field of magnitude V/h, and recording the probe signal $V_M$. For example, the charge on the probe can be determined by measuring the voltage across a known capacitance using a high impedance operational amplifier. To account for possible long term drift in the zero reference of the signal, a ground plane can be momentarily inserted between the probe and belt and the capacitor momentarily shorted to create a zero voltage reference condition. The sensor 240 is displaced a sufficient distance from the belt 206 to avoid contact with the sheets 216 of recording media, but still within a distance sufficient to determine the amount of the electrostatic field. This displacement distance can vary depending on the type and sensitivity of the sensor 240. The sensor 240 is configured to provide an electrostatic field signal indicating the level of the electrostatic field, such as by providing a voltage level. In one embodiment, the sensor can be a point sensor which can provide a measurement of an electrostatic field at a single point along the cross-process direction. In another embodiment, the sensor can be an array type of sensor, which can include a full-width array sensor, if desired. For instance, if the electrostatic field is fairly uniform across the belt in the cross-process direction, a point sensor can be appropriate. If, however, the sensed electrostatic field in non-uniform, a full width array sensor can be used to provide an average value of the electrostatic field across the belt. In another embodiment, the sensor 240 can include an electrostatic voltmeter. While the sensor 240 is illustrated as being located above the belt 206 on the same side as the location of the printheads 202, the sensor 240 can also be located below the belt 206.

A controller 250, such as that previously described with respect to FIG. 4, is operatively connected to the plurality of printheads 202, the drive roller 210, the electrostatic field adjustment device 230, and to the sensor 240. The controller 250 includes a DC bias adjustment mechanism 252 which is operatively connected to the sensor 240 through an electrostatic field average value determiner 254. In one embodiment, the sensor 240 provides a value of the sensed electrostatic field to the average field value determiner 254 which is configured to determine an average value of the electrostatic field over a predetermined period of time as described below. While the average field value determiner 254 is illustrated as a being separate from the controller 250 and separate from the sensor 240, the determiner 254 can be incorporated into either one of the controller 250 or the sensor 240, or both. In another embodiment, the sensor 240 can be a full width array sensor which due to the configuration thereof provides an average value of the electrostatic field. To arrive at an average value of the electrostatic field, the controller 250 samples the received value of the electrostatic field at predetermined time intervals. In another embodiment, the average value determiner 254 can be incorporated into the controller 250 to generate an average value of the sensed electrostatic field to the DC bias adjustment mechanism 252.

Once the average value of the electrostatic field is determined, the DC bias adjustment mechanism 252 compares the received electrostatic field average value to a predetermined electrostatic field value. The result of the comparison is subsequently used by the controller 250 to generate a control signal which is transmitted to the power supply 236 to adjust the electrostatic field generated by the corotron 231. The adjusted electrostatic field applied to the recording media and the belt adjusts the electrostatic field in the print zone to an acceptable value.

A lookup table can be incorporated into the controller or stored in a memory associated with the controller 250. The lookup table includes a plurality of values of electrostatic fields each one being associated with a value of a power supply signal to be transmitted to the corotron power supply 236. The controller 250 upon receipt of the average value of the field sensed by the average value determiner 254 accesses the lookup table and retrieves the appropriate value of the power supply signal for transmitting to the corotron power supply 236. By sensing the electrostatic field and incorporating the controller to adjust the DC current generated by the corotron power supply, a closed loop control system is provided. In another embodiment, an algorithm to calculate the value of the power supply signal responsive to the sensed value of the average value determiner 254 can be incorporated into the controller 250.

The printer 200 further includes a belt support 256 which is disposed adjacent to and beneath the belt 206, as illustrated, to support the transport belt 206 as the belt moves through the print zone 204. The belt support 256 can include a conductive platen subtending the belt. The support 256 extends approximately from an area just outside each of the ends of the print zone 204. In one embodiment, the belt support 256 is made of a plurality of conductive metal segments 258, each of which alternates with a non-conductive segment 260. In FIG. 1, the non-conductive segments 260 are illustrated with lines and the conductive segments 258 are illustrated as solidly shaded segments. Each of the non-conductive segments is generally positioned beneath the printhead nozzles of each of the printheads 202 to thereby reduce the likelihood of electrostatic fields, which can be present in the support 256 affecting the deposition of ink. In one embodiment, the non-conductive segments do not include any material, metal or otherwise, such that a space or an empty chamber is located beneath the printheads and beneath the belt 206. In another embodiment, the non-conductive segments can include an electrically non-conductive material when an air bearing approach is used to transport the media. In an air bearing approach, the materials of the platen 256, including the segments 260, can include a material selected to have a low propensity for triboelectric charging. In such an embodiment the segments 260 can be an insulating material. In fact, the entire platen 256 can be a non-conductive material.

The printer 200 can also include a vacuum hold-down device 262 which includes a housing 264 and a vacuum generator 266 operatively connected to the housing 264 and to the controller 250. A vacuum or negative pressure applied by the vacuum hold-down device 262 is directed to the transport belt 206 through a plurality of holes or apertures (not shown) located in the segments 258. The purpose for the vacuum is to maintain flatness of the belt 206 through the printhead region 204. In addition, the transport belt 206 can optionally include a plurality of holes or apertures (not shown). Upon the application of the vacuum through the apertures of the belt, the sheets of recording media 216 are held substantially flat to the transport belt. While the use of a vacuum hold-down device 262 with holes or apertures in the transport belt 206 is not necessary, the use of a vacuum hold-down device can provide for additional stabilization of the sheets of recording media beyond the stabilization provided by the electrostatic tack forces. Further stabilization of the sheets in the print zone 204 can be useful due to the allowed reduction of the charge applied to the sheets and the resulting reduction of the electrostatic fields generated by the sheets of recording media after moving past the corotron 231. The applied vacuum keeps the belt in place against the platen and the sheet is tacked to the belt by electrostatic forces. The field above the sheet is reduced, while maintaining the tacking force between the belt and the sheet. In another embodiment, the applied vacuum can be used to hold the hold or to assist holding the sheet to the belt.

Figure 2:
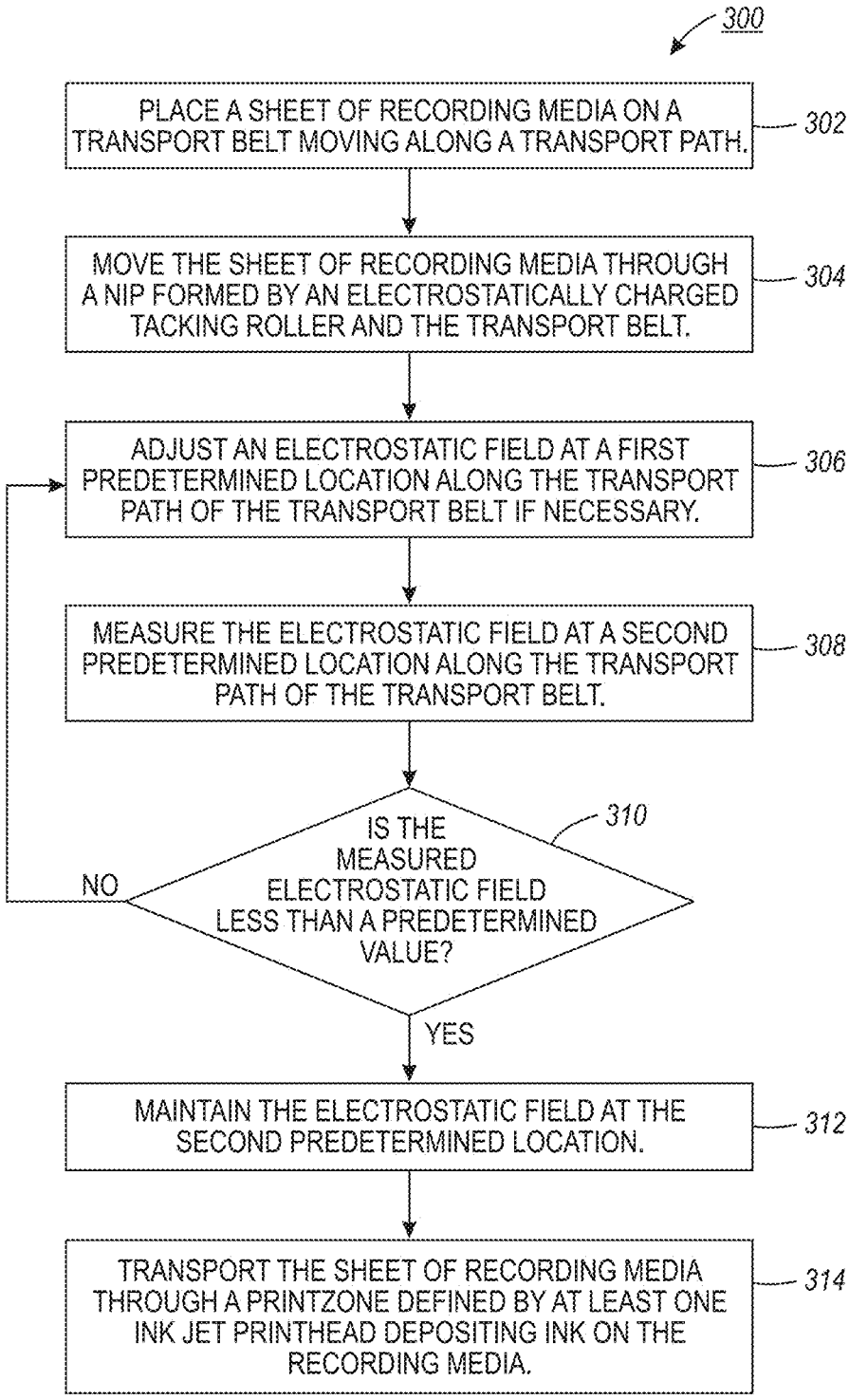
FIG. 2 is a flow diagram of a method to adjust the electrostatic field in a print zone of an ink jet printer depositing ink on recording media transported through the print zone by a transport belt.
Figure 3:
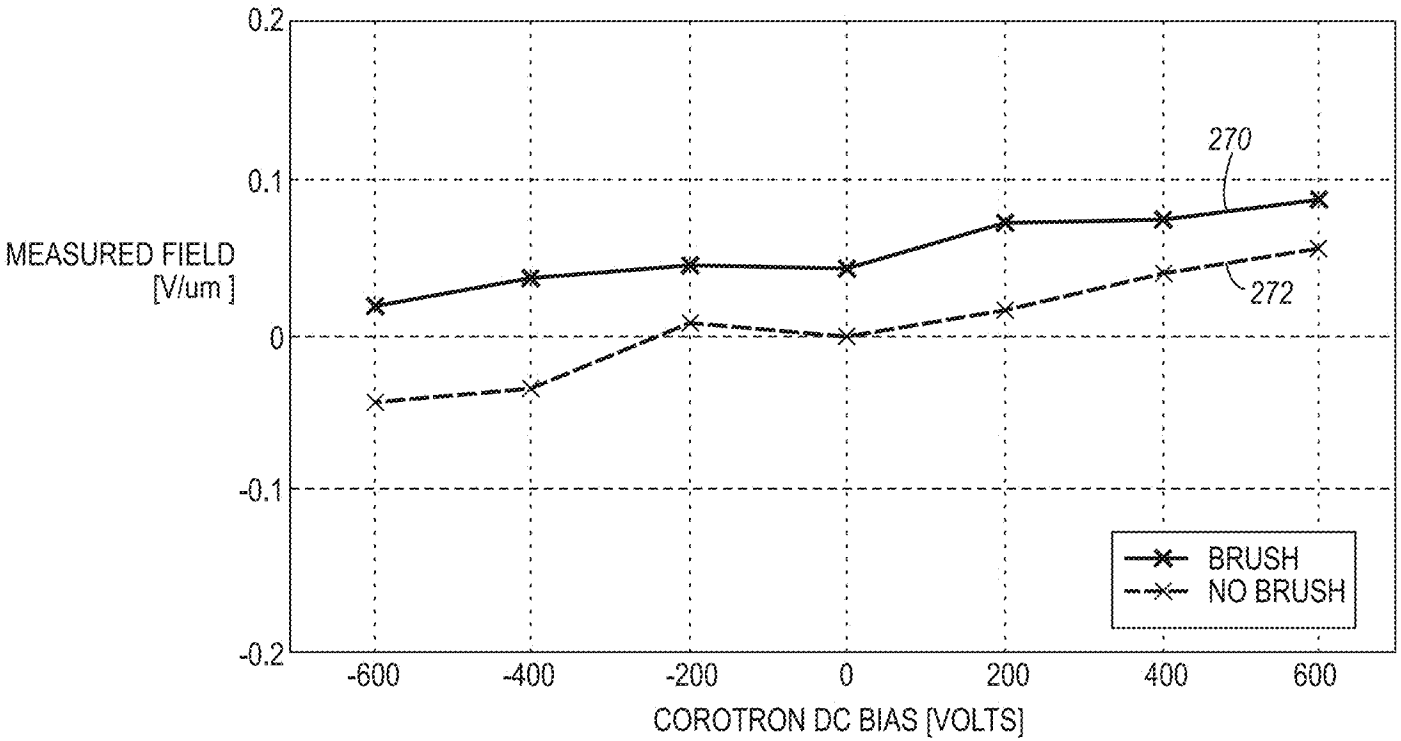
FIG. 3 is a graph of a measured electrostatic field versus a direct current bias on an electrostatic field producing corotron.

FIG. 2 illustrates one example of a method used to adjust the electrostatic field in the print zone of an inkjet printer. The flow diagram 300 of FIG. 2 describes a method applicable to the embodiments described herein, as well as to other embodiments incorporating the teachings described herein. As illustrated in FIG. 3, a sheet of recording media is placed on the transport belt moving along a transport path (block 302). As previously described, the sheet is placed on the transport belt 206 at a point located prior to the electrostatic tacking device 218. After the sheet is placed on the belt 206, the belt 206 moves the sheet of recording media 216 through a nip provided by the electrostatic tacking device 218 after being moved into contact with the blade 226 (block 304).

After the sheet of recording media 216 moves through the nip 224, the corotron 231 adjusts the electrostatic field at a first predetermined location along the transport path of the transport belt, if necessary (block 306). The electrostatic field is not adjusted if a determination is made that the electrostatic field is within a predetermined range of values. Once the adjustment is made, if necessary, the electrostatic field is measured at a second predetermined location along the transport path (block 308). The measured value of the electrostatic field, which can be measured in volts per units of distance such as volts/meter or volts/μm, is compared to a predetermined value of a desired electrostatic field at the location of the measurement (block 310). In one embodiment, the desired value of the electrostatic field is approximately zero. While a value of zero volts/μm is desired, the average value of a desired electrostatic field can be selected to be other values by taking into account, for instance, the distance from the location at which the measurement is made to the print zone, where conditions within the printer can affect the value of the electrostatic field in the print zone.

Once the comparison is made at block 310, a determination is made by the controller 250 which is configured to adjust the DC bias of the corotron power supply 236 using the average value of the electrostatic field measured by the average value determiner 254. If the average value of the electrostatic field is greater than the predetermined value of the desired electrostatic field, the controller 250 provides an adjustment signal to the power supply 236 to adjust the DC bias applied to the coronode 232. The electrostatic field is adjusted at block 306. If, however, the measured electrostatic field is less than the predetermined value, then the electrostatic fields generated by the corotron 231 is not modified (block 312). Once the electrostatic field is adjusted to the desired value, the sheet of recording media is transported through the print zone (block 314).

In one embodiment, the electrostatic field can be sensed and adjusted at predetermined time intervals. Because the electrostatic field probe 240 can provide electrostatic field readings on a continuous basis, predetermined time intervals can be selected according to the printer environment, the components used in the printer, or the type of recording media being imaged. In one embodiment, the electrostatic field readings are taken every 10-100 milliseconds for a belt moving at approximately 0.5 to 2.0 meters per second. Because the electrostatic field readings are averaged over a period of time, the controller 250 generates and transmits an adjustment signal to the electrostatic field adjustment device 230 approximately 10 to 50 milliseconds.

In another embodiment, the controller 250 can be configured to recognize different types of recording media being processed and adjust the electrostatic fields accordingly. For instance, one type of recording media can retain one level of an electrostatic charge and a second type of recording media can retain another level of an electrostatic charge after moving through the electrostatic tacking device 218. The controller 250, upon determining the type of media being imaged, can adjust the amount of electrostatic field applied by the electrostatic field adjustment device 230 based on the type of media. The controller 250 can determine the type of media either through being operatively connected to a sensor configured to determine the electrostatic field of the media held by a storage tray, for instance, or can be determined from an input received from an operator at a user interface which identifies the type of media.

In still another embodiment, the printer can move a test sheet of recording media through the print zone 204 to determine an initial value of an electrostatic field. This initial value of the electrostatic field can be used by the controller 250 to enable the field adjustment device 230 to modify, if necessary, the electrostatic field within the print zone 204.

FIG. 3 is a graph of a measurement of an electrostatic field versus a direct current bias of an electrostatic field producing corotron. In the graph of FIG. 3, the DC voltage applied to the AC coronode of the corona device was varied from approximately −600 volts to approximately +600 volts. The electrostatic field was measured with the sensor 240 located adjacently to the belt 206 and displaced from the edge of the belt approximately fourteen (14) millimeters. In one embodiment, the readings were taken with a conductive fiber brush disposed adjacently to the surface of the belt opposite the surface upon which the corotron 231 which applies an electrostatic field. The brush, located to the left of the corona device 234 in FIG. 1, is placed sufficiently far from the active corona region so that the brush does not greatly influence the effective capacitance $C_T$ discussed previously. Mainly such a brush can affect the initial belt charge density entering the corotron region, and this can shift the field levels slightly. As illustrated in FIG. 3, a line 270 illustrates that by varying the DC bias to the corotron, the measured electrostatic field can be varied from approximately 0 to 0.1 volts/μm. In an embodiment with the application of a brush to the transport belt 206, the curve is shifted but the sensitivity to the DC bias on the corotron is similar.

As can be seen with respect to FIG. 3, the amount of adjustment made to the electrostatic field by the corotron 231 is relatively small. In the case shown, the metal corotron shield and conductive metal parts below the belt are placed at least effectively 10 mm away from the belt so that DC +−600 volts on the coronode only produces a field change of around +−0.05 Volts/micron, which is an expected level of change. If desired, the sensitivity to the DC coronode level can be increased by introducing a grounded conductive member below the belt at an effective spacing that is less than an effective 10 mm distance.

The electrostatic field can affect different types of ink differently depending on the type or composition of the ink. The type of ink, however, typically does not affect the electrostatic field. High conductivity inks can experience more stress than lower conductivity inks. An induced charge on the ink drops can occur due to conduction through the conductive ink from the grounded metal printhead parts when there is a field present between the media and the printhead. The charge induced on the ink in the presence of the field creates an electrostatic force on the ink drops and this field can affect ink drop speed and placement, ink reservoir refill mechanics, and imaging ink splitting and back splatter issues that can cause printhead contamination problems. In addition, low viscosity ink materials being jetted can be experience more stress than higher viscosity inks due to a larger effect on the ink drop trajectory due to the electrostatic forces on the ink drops caused by the presence of fields. If the ink is substantially insulating, conductive charging of the ink drops due to the presence of an electrostatic field below the printhead typically does not substantially occur. However, the ink drops can polarize in the presence of the field, and this can cause an effective charge separation on the ink drop, which can affect ink drop placement. The amount of polarization increases with increasing dielectric constant of the ink, so ink materials having a high dielectric constant can be experience more stress than inks having a lower dielectric constant.

It will be appreciated that variants of the above-disclosed and other features and functions, or alternatives thereof, can be desirably combined into many other different systems, applications or methods. For instance, the described embodiments and teachings can be applied to phase change ink printing systems printing directly to a continuous web. In addition, while the system and method for reducing electrostatic fields has been described with respect to the configuration of the printer of FIG. 1, the system and method of reducing electrostatic fields can be incorporated into the printer of FIG. 4 as well as other printers where inkjet printing can be affected by an electrostatic field. Such printers can include those that do not incorporate electrostatic hold-down devices, but which develop an electrostatic field in the print zone capable of producing image artifacts. Various presently unforeseen or unanticipated alternatives, modifications, variations or improvements can be subsequently made by those skilled in the art that are also intended to be encompassed by the following claims.

It can also be appreciated that many type of AC corona devices can be used in the application. For instance, a corona device with a coronode consisting of a small diameter corotron wire can be used for the measurements made for FIG. 3. Acceptable devices can include devices that use pin coronodes, devices that use dielectric coated wires typically referred to as a "dicorotrons", and many other charging devices known in the art. Devices that produce a sufficiently large slope $m_c$ for the characteristic curve, as described previously, can be used.

What is claimed is:

1. A method of adjusting an electrostatic field in a print zone of an inkjet printer to reduce the effects of the electrostatic field during the deposition of ink on recording media moving though the print zone in a process direction comprising:

applying a charge with a corotron to the recording media on a transport belt prior to the recording media moving through the print zone to affix the recording media to the transport belt, which is configured to transport media in a process direction past a printhead in the print zone;

measuring with a sensor disposed adjacent to the transport belt an electrostatic field on the transport belt at a location prior to the recording media entering the print zone, the sensor generating a signal indicative of a strength of the electrostatic field on the transport belt; and modifying the charge on the recording media in the print zone in response the signal generated by the sensor, the charge being modified with a controller operatively connected to the corotron and the sensor.

2. The method of claim 1, the application of the charge with the corotron further comprising:

contacting the recording media with an electrostatically charged roller.

3. The method of claim 2, the modification of the charge on the transport path further comprising:

adjusting the charge on the recording media with a non-contacting electrostatic field generator.

4. The method of claim 3 further comprising:

supporting the recording media in the print zone with a support having non-conductive portions.

5. The method of claim 3 further comprising:

supporting the recording media in the print zone with a support having conductive portions and non-conductive portions.

6. The method of claim 3 further comprising:

supporting the recording media in the print zone with a non-conductive support.

7. The method of claim 1, the application of the charge with the corotron further comprising:

applying the charge with an alternating current corona device having an adjustable DC bias.

8. The method of claim 1, the application of the charge with the corotron further comprising:

applying the charge with a coronode disposed within a corotron shield, the coronode being operatively connected to a power supply to enable the power supply to provide an alternating current signal and a direct current signal to the coronode.

* * * * *